US012102170B2

(12) United States Patent
Swigart et al.

(10) Patent No.: US 12,102,170 B2
(45) Date of Patent: Oct. 1, 2024

(54) ARTICLE OF FOOTWEAR WITH MIDSOLE HAVING VARIABLE STIFFNESS

(71) Applicant: Acushnet Company, Fairhaven, MA (US)

(72) Inventors: John F. Swigart, Portland, OR (US); Robert S. Bento, Raynham, MA (US)

(73) Assignee: Acushnet Company, Fairhaven, MA (US)

( * ) Notice: Subject to any disclaimer, the term of this patent is extended or adjusted under 35 U.S.C. 154(b) by 283 days.

(21) Appl. No.: 17/681,112

(22) Filed: Feb. 25, 2022

(65) Prior Publication Data

US 2023/0270204 A1 Aug. 31, 2023

(51) Int. Cl.
*A43B 13/12* (2006.01)
*A43B 13/18* (2006.01)

(52) U.S. Cl.
CPC ..... *A43B 13/125* (2013.01); *A43B 13/187* (2013.01)

(58) Field of Classification Search
None
See application file for complete search history.

(56) References Cited

U.S. PATENT DOCUMENTS

| | | | | |
|---|---|---|---|---|
| 4,798,010 | A * | 1/1989 | Sugiyama | A43B 13/187 36/31 |
| 7,886,460 | B2 * | 2/2011 | Teteriatnikov | A43B 13/145 36/31 |
| 8,959,798 | B2 * | 2/2015 | Pfister | A43B 13/125 36/25 R |
| 10,743,612 | B2 * | 8/2020 | Iuchi | A43B 13/04 |
| 11,425,958 | B2 * | 8/2022 | Bidal | A43B 5/001 |
| 2013/0326908 | A1 * | 12/2013 | Grott | A43C 15/16 36/62 |
| 2014/0182169 | A1 * | 7/2014 | Mack | A43B 13/141 36/102 |
| 2016/0021977 | A1 * | 1/2016 | Madore | A43B 13/12 36/30 R |
| 2020/0383421 | A1 * | 12/2020 | Bidal | A43B 13/026 |

* cited by examiner

*Primary Examiner* — Jila M Mohandesi
(74) *Attorney, Agent, or Firm* — Williams Mullen; F. Michael Sajovec

(57) ABSTRACT

An article of footwear with a midsole having a variable stiffness configured to provide pressure gradients to reduce plantar pressure. In some embodiments, the two-piece midsole may include a first foam material vertically aligned with a perimeter of the article of footwear and a second foam material vertically aligned with the heel region and a toe box of the forefoot region. The combined height of the firm foam material and the soft foam material varies across the midsole.

20 Claims, 9 Drawing Sheets
(2 of 9 Drawing Sheet(s) Filed in Color)

ARTICLE OF FOOTWEAR WITH MIDSOLE HAVING VARIABLE STIFFNESS

FIELD OF THE DISCLOSURE

The disclosure relates generally to the field of footwear. More specifically, the disclosure relates to the field of footwear with a midsole having variable stiffness.

BACKGROUND

The midsoles of footwear are known to strongly affect the sensation of cushioning/comfort by redistributing load magnitudes and rates on the bony load-bearing structures and soft tissues of the foot. A single-density foam of a particular Asker C hardness is most commonly used as a midsole to provide a structure that merely compresses under walking loads. Single density foams, however, are of a uniform hardness. Thus, a choice must be made between having a harder sole for support or a softer sole for comfort. This is particularly a problem under high plantar pressure in which support is compromised if a softer hardness is selected for comfort for other areas of the foot not under plantar pressure. Thus, current midsoles are unable to simultaneously provide proper support at regions of the foot under plantar pressure and/or comfort for areas of the foot under less plantar pressure.

SUMMARY

To this end, the present disclosure provides for an article of footwear having a midsole that reduces plantar pressure and pressure gradients. It may provide support and stability while performing certain physical activities (e.g., swinging a golf club) yet remain comfortable for walking and standing. The following presents a simplified summary of the disclosure in order to provide a basic understanding of some aspects of the disclosure. This summary is not an extensive overview of the disclosure. It is not intended to identify critical elements of the disclosure or to delineate the scope of the disclosure. Its sole purpose is to present some concepts of the disclosure in a simplified form as a prelude to the more detailed description that is presented elsewhere.

Accordingly, one aspect of the present disclosure is directed to an article of footwear configured to provide stability and traction while walking on a surface. The article of footwear may comprise an upper, an outsole and a midsole having a variable stiffness configured to provide pressure gradients based on the applied load or pressure. The midsole may have a stiffness that dynamically varies and may be predetermined based on the distribution of plantar pressure across the midsole.

In some embodiments, an article of footwear is provided and includes an upper, an outsole, and a midsole having a variable stiffness configured to reduce peak plantar pressures, wherein variable stiffness is provided by a firm foam material vertically aligned with a perimeter of the article of footwear and a soft foam material vertically aligned with a central heel region and a toe box of the forefoot region within the perimeter.

These and other aspects will become apparent to those skilled in the art after a reading of the following description when considered with the drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Illustrative embodiments of the present disclosure are described in detail below with reference to the attached drawing figures and wherein.

DETAILED DESCRIPTION

Figure 1:
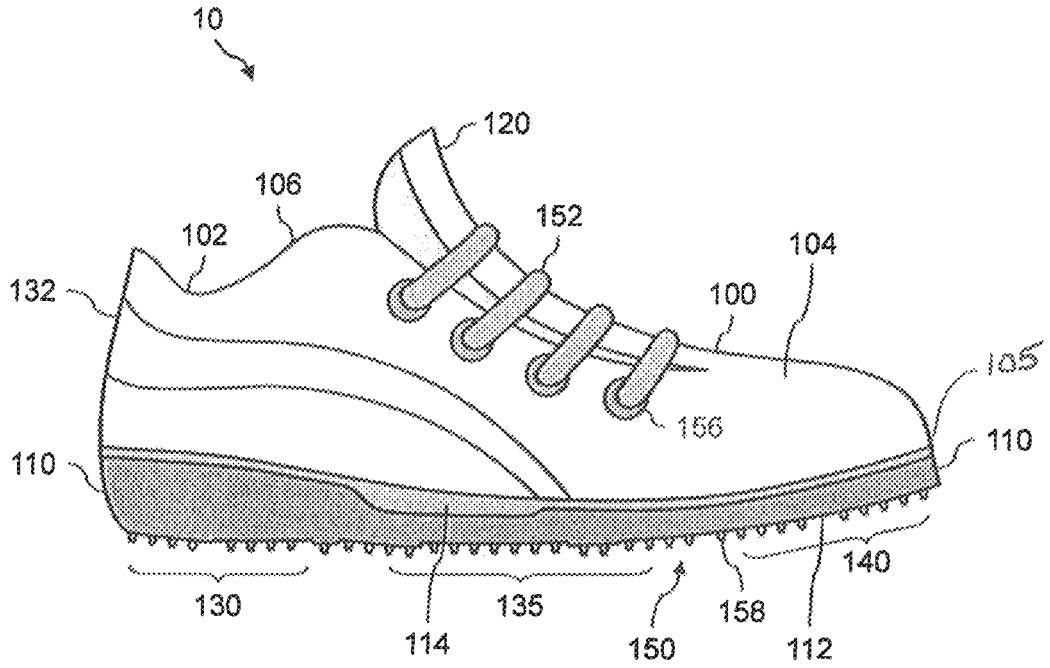
FIG. 1 is a side view of an article of footwear according to one embodiment.

Several embodiments will be described more fully in reference to the accompanying figures. However, this disclosure should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "attached," "coupled" or "connected" to another element, it can be directly attached, coupled or connected to the other element or intervening elements may also be present. In contrast, when an element is referred to as being "directly attached," directly coupled" or "directly connected" to another element, there are no intervening elements present.

All patents, patent applications and publications referred to herein are incorporated by reference in their entirety. In case of a conflict in terminology, the present specification is controlling.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Referring now to FIG. 1, an article of footwear 10 configured to provide stability and comfort to a wearer walking on a wide variety of walking surfaces such as encountered while playing golf. The article of footwear may include an upper 100 and a sole 110. The article of footwear 10 may further include a heel region 130, a midfoot region 135 and a forefoot region 140.

The heel region 130 may generally correspond with the rear portions of a foot, namely, the area surrounding and below the Achilles tendon, the posterior of the heel, and the talus and calcaneus bones. A forefoot region 140 may generally correspond with a front of a foot, namely, the toes and metatarsal, phalange, and sesamoid bones. The midfoot region 135 may generally correspond with a middle of the foot, namely, the arch and the navicular, cuboid, and cuneiform bones. It is understood that the heel region 130, midfoot region 135, and forefoot region 140 are intended to represent general areas of footwear and not demarcate precise areas.

The article of footwear 10 may have a medial side that extends from a forefoot region 140 to a heel region 130 and a lateral side that extends from a forefoot region 140 to a heel region 130. The lateral side and the medial side may be opposite one another. In some embodiments, the lateral side and medial side may be generally parallel to one another. The lateral side may generally correspond to an outside area of a foot and a surface that faces away from a person's other foot. The medial side may generally correspond with an inside area of a foot and a surface that faces toward a person's other foot.

The upper 100 may have an interior surface 102 and an exterior surface 104. The interior surface 102 may partially define an area configured to receive a person's foot. The upper 100 may be configured to extend over a person's foot, along the medial and lateral sides of the foot, and around a forefoot region and a heel region of the foot. The area configured to receive a person's foot may be accessed from an ankle opening defined by a collar 106. The footwear 10 may include a tongue 120.

The upper 100 may be constructed from a wide variety of suitable materials and may be any appropriate material now known or later developed, including, but not limited to, leather, suede, fabric, canvas, weaves, knits, man-made polymer fibers, nylon, polyester, or cotton. The upper 100 or a portion of the upper may be elastic or inelastic. The upper 100 may further include at least a portion that may be inflexible, may be rigid or may be semi-rigid.

The upper 100 may further include a heel counter 132 at the heel region 130. The heel counter 132 may reinforce the upper 100 and limit movement of a person's heel. The heel counter 132 may wrap around the heel region 130 and extend forward along both the lateral side and the medial side.

The footwear 10 may include one or more closure systems for securing a user's foot, the selection of which is within the skill of one in the art. Examples of closure systems may include any suitable closure system including conventional laces, a lace tightening system as described in U.S. Pat. No. 10,070,695 and incorporated herein by reference in its entirety, and a closure system as described in U.S. application Ser. No. 17/355,390 filed Jun. 23, 2021 and incorporated herein by reference in its entirety. For example, the closure system may comprise a lace 152 above the upper 100 and configured to interact with the outer surface size. The lace 152 may be entirely or partially visible. In other embodiments, lace guides 156 may be placed such that the lace 152 is not in direct contact with the upper 100.

In some embodiments, the lace 152 may be between an exterior surface of the upper 104 and an interior surface of the upper 102. In such embodiments there may be a channel for the laces between the exterior surface of the upper 104 and the interior surface of the upper 102. The lace guides 156 may also be positioned between the exterior surface of the upper 104 and the interior surface of the upper 102.

The sole 110 may include an outsole 112, a midsole 114, and an insole (not shown). The sole 110 may be coupled to the upper 100 at a bite line 105. The sole 110 may be configured to attenuate forces or provide support or cushioning. The insole may be designed to provide cushioning and comfort for a person. The insole may be removable and may be above the midsole 114 when in use. In some embodiments, the insole may be designed to provide support. The insole may be flexible, semi-rigid, or rigid. The midsole 114 may be formed from one or more compressible materials that provides cushioning and support.

The outsole 112 may be below the midsole 114 and may be designed to interact with a ground surface. The outsole 112 may be designed to impart traction. In some embodiments, spikes, cleats, or other devices for additional traction may be coupled to the outsole 112. Such devices may be releasably coupled to the outsole 112. In other embodiments, such devices may be fixedly coupled to the outsole 112.

Figure 2:
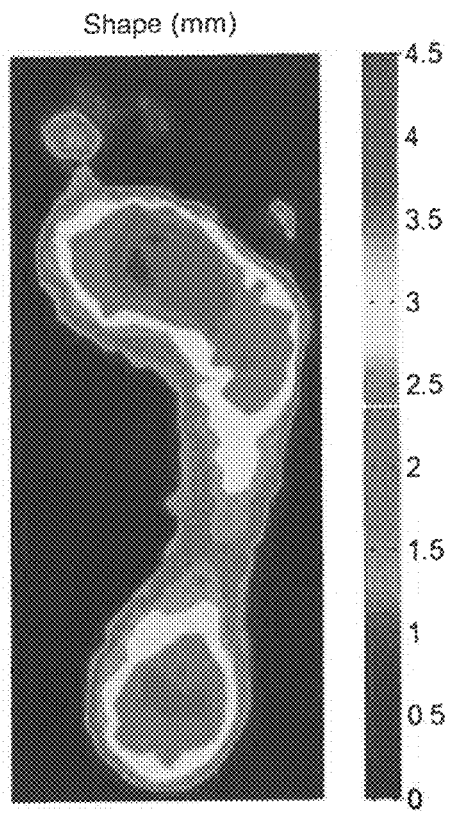
FIG. 2 is a color contour plot for the unloaded contoured structures and plantar pressures of a foot while a person is standing.
Figure 2:
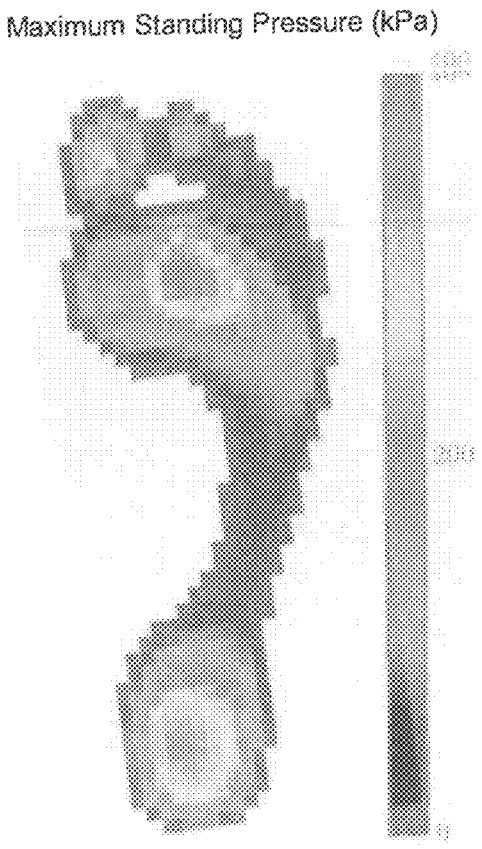
Figure 3:
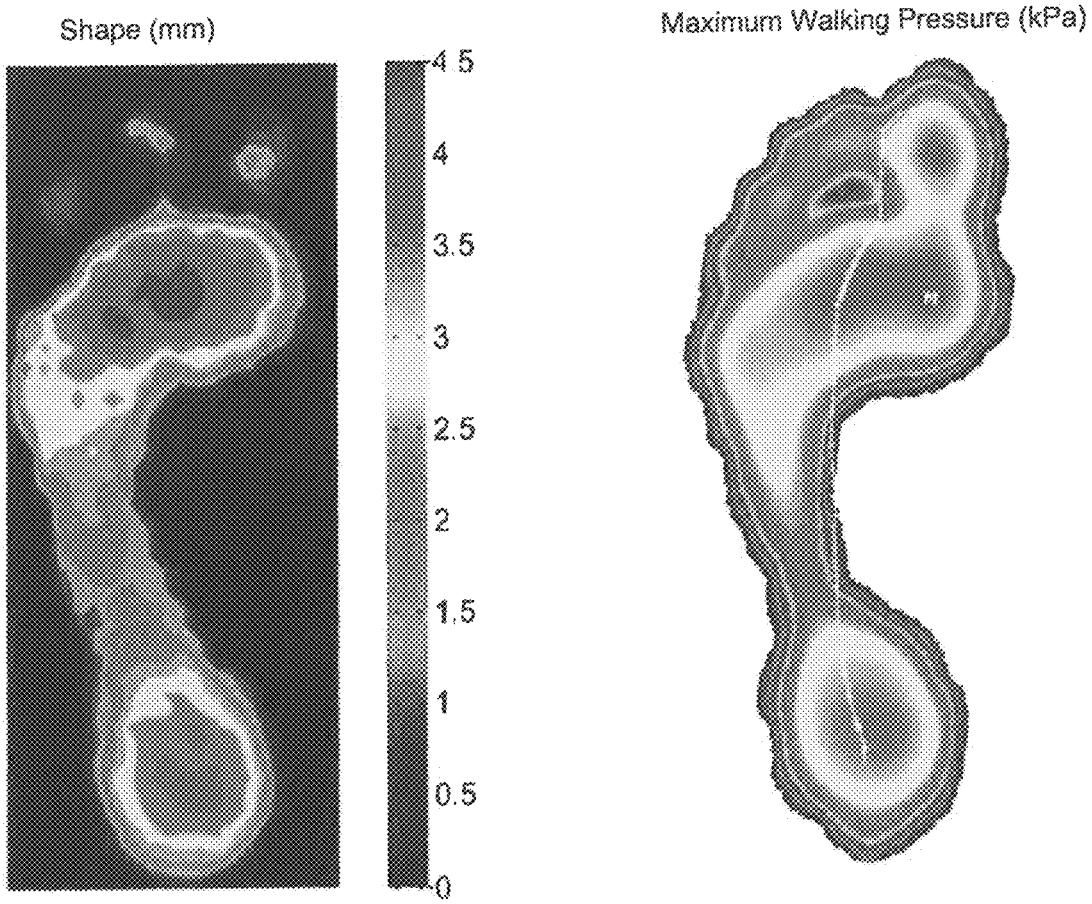
FIG. 3 is a color contour plot for the unloaded contoured structures and plantar pressures of a foot while a person is walking.

FIG. 2 and FIG. 3 include plantar surface unloaded shape mappings and loaded pressure mappings and are illustrated in color. These mappings reveal similar topologies across a wide range of healthy feet. In one embodiment, as shown in FIG. 2, the maximum standing pressures (kPa) under the foot may closely align with the unloaded contoured structures of the foot (shape in mm). Likewise, as shown in FIG. 3, the maximum walking pressures (kPa) under the foot may follow the unloaded contour shape of the foot (mm). Specifically, with respect to plantar pressure, hotter color regions, such as red and yellow regions of the contour plot, indicate higher plantar pressures whereas colder color regions, such as blue and green regions, indicate lower plantar pressures. As indicated by the magenta color, the highest plantar pressures are located at and under the heel and forefoot regions of a person's foot, and more particularly, at the calcaneus and ball of the foot. The lower plantar pressures are found at the midfoot region of a foot and around the edges of the foot. Plantar pressure gradients may be found around the heel and forefoot regions of a foot. During walking, the plantar pressure may be distributed among a greater area in the forefoot and heel regions as compared to standing loads, as walking loads exceed standing loads, and therefore the plantar pressure gradients may also be greater. For example, the hallux 142 and medial side 144 of the forefoot region 140 may exhibit higher plantar pressures when walking versus standing. Some regions, such as the medial side of the midfoot region, may have minimal plantar pressure.

Figure 4:
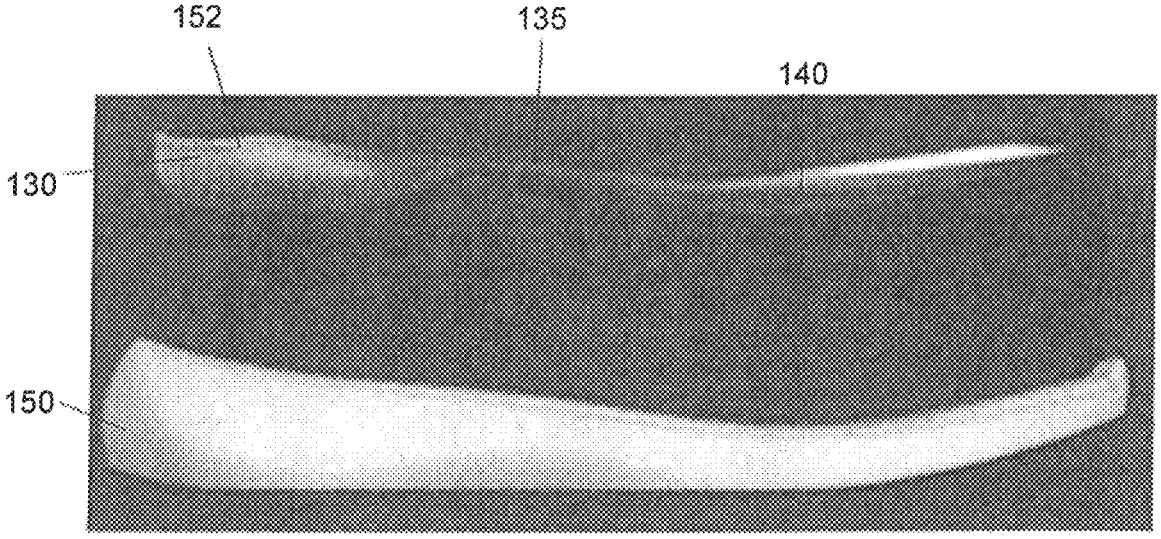
FIG. 4 is side elevation view of a core piece and a perimeter piece according to one embodiment.

According to various embodiments of the invention, in some embodiments, the hardness of the midsole 114 may vary at different regions to improve plantar pressure distribution across the surface of a foot and reduce plantar pressure gradients based on a standard contour plot of peek plantar pressure. For example, in one embodiment, the midsole 114 may include firmer areas for regions that typically experience higher plantar pressures when the article of footwear is worn and softer areas for regions that have lower plantar pressures during wear. In this manner, foam stiffness gradients may be established and adjusted according to peak plantar pressures. The difference in firmness and softness may be provided by a plurality of foamed thermoplastic elastomer materials such as polyurethane and ethylene-vinyl copolymer acetate and having differing stiffnesses. Referring to FIG. 4, in some embodiments, the midsole 114 may be a two-piece midsole with each piece having a foam material with a different firmness. For example, the two-piece midsole may include a perimeter piece 150 comprising a soft foam material and a core piece 152 comprising a firm foam material. The core piece 152 may be configured to be inserted within the perimeter piece 150. In other embodiments, the perimeter piece 150 may be comprised of a firm foam material and the core piece 152 may be comprised of a soft foam material. In another embodiment the perimeter piece 150 and the core piece 152 may both comprise a firm foam or may both comprise a soft foam. The soft foam material may have an Asker® hardness between about 35 to 50, sometimes an Asker® hardness between 42 and 48 and in some instances, an Asker® C hardness of about 45. The firm foam material may have an Asker® C hardness between about 55 and 70, sometimes an Asker® hardness between 57 and 63, and in some instances, an Asker® C hardness of about 60.

Figure 5:
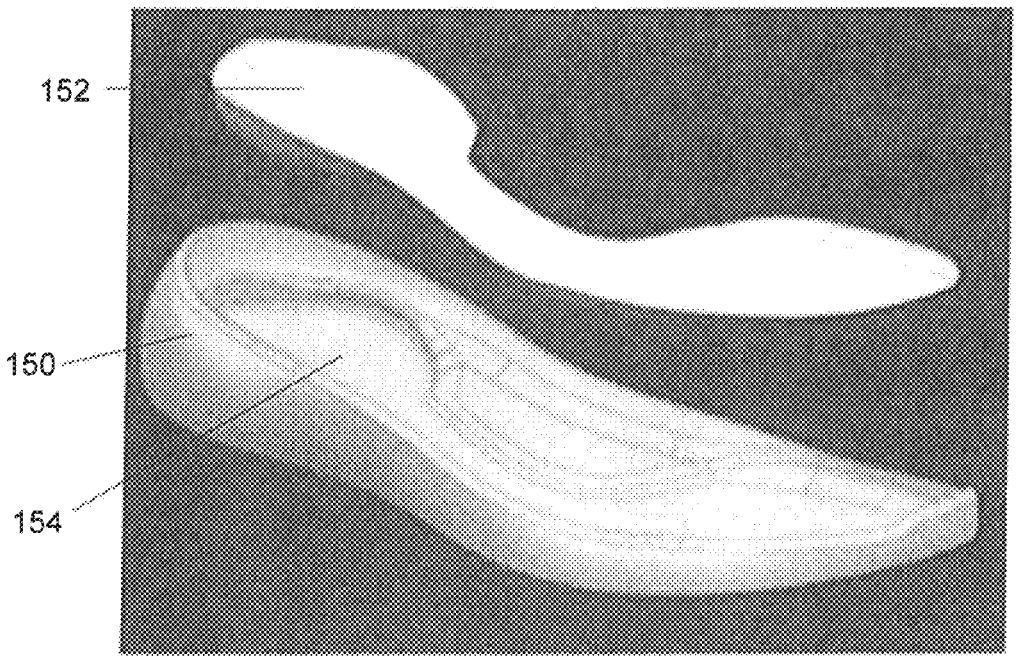
FIG. 5 is a front perspective view of the core piece and perimeter piece shown in FIG. 4.
Figure 6:
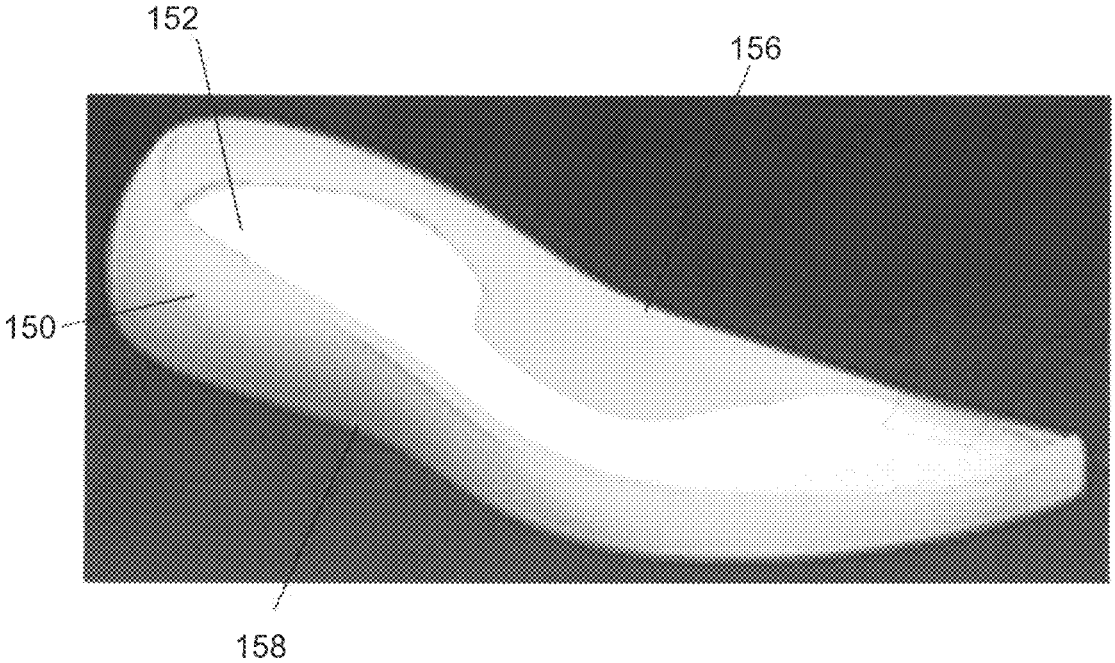
FIG. 6 is a front perspective view of a core piece inserted into a perimeter piece to form the midsole according to one embodiment.
Figure 7:
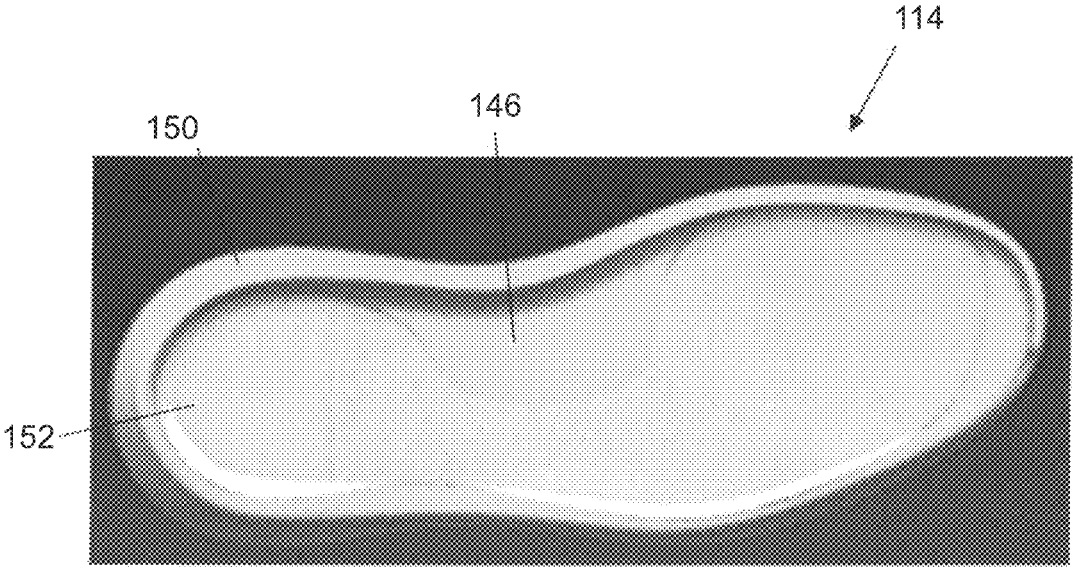
FIG. 7 is a top elevation view of the midsole shown in FIG. 6.

As shown in FIGS. 5-7, the perimeter piece 150 may include a recess 154 for inserting the core piece 152 therein. The depth of the recess 154 may vary within the perimeter piece 150. The recess 154 may have a greater depth to accommodate regions of the core piece 152 having a greater height. When the core piece 152 is inserted into the recess 154, the top of core and perimeter pieces may provide a substantially uniform top surface as seen in FIGS. 6 and 7. In some embodiments, certain regions of the perimeter piece 150 may lack a recess where minimal plantar pressure is found. For example, the recess 154 may not extend into the medial midfoot region 146 aligning with the arch of a foot. The perimeter piece 150 may also form sidewalls 156 and the bottom 158 of the midsole 114. The firm foam, soft foam and/or midsole may have height gradients within each region that may be dependent on the amount of plantar pressure applied and the surface area of the applied pressure. The gradients may be linear or non-linear. Regions wherein the applied pressure has a greater surface area may have a more gradual height gradient between the highest plantar pressure point and lower plantar pressure points compared to regions wherein applied plantar pressure occupies a small area.

Figure 8:
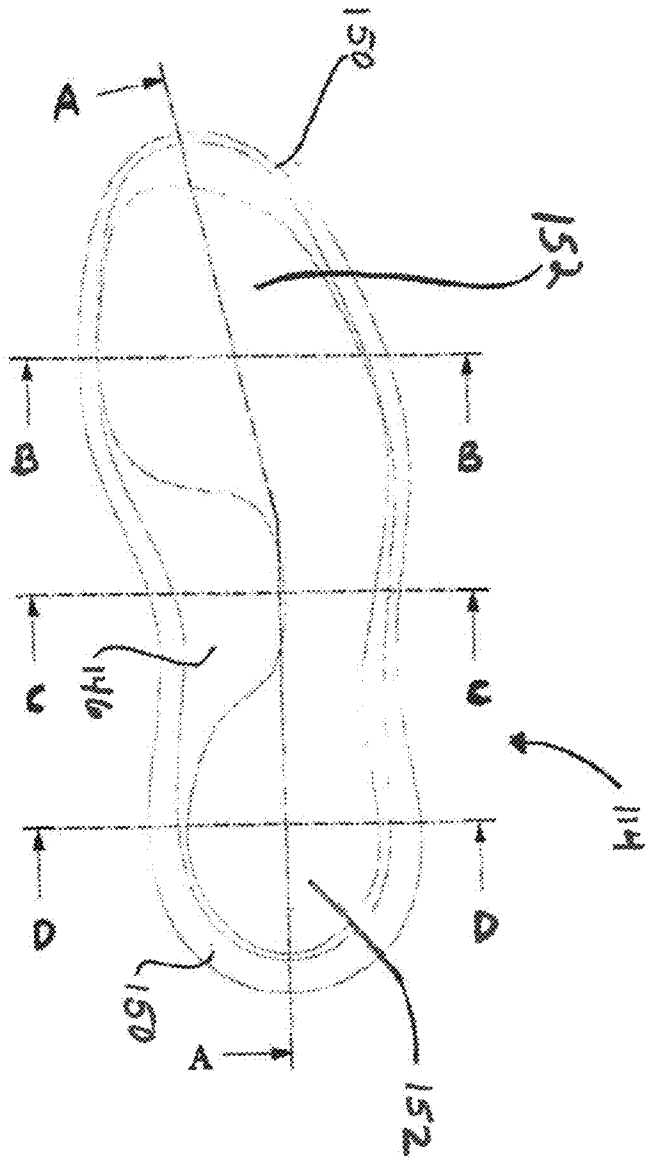
FIG. 8 is a top view of midsole shown in FIGS. 6 and 7.
Figure 9:
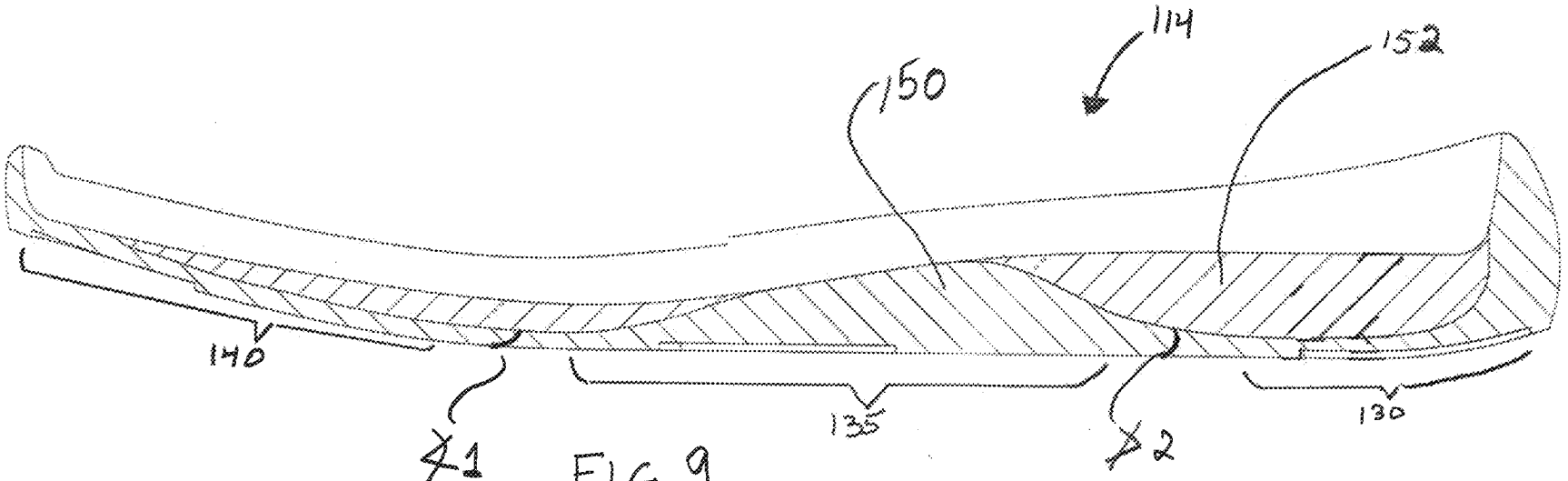
FIG. 9 is a cross-sectional view along line A-A of FIG. 8.

Referring to FIG. 8 and FIG. 9, in one embodiment, the two midsole pieces may be vertically aligned. For example, a firm foam material may be provided that is vertically aligned with the perimeter of the article of footwear. A soft foam material may be provided that is vertically aligned with a central heel region and a toe box within the perimeter. The total height of the midsole 114 may be the sum of the individual heights of each piece and will vary across the midsole. The firm foam material and the soft foam material may differ in height and may be contoured with variances in their height between the two materials. For example, the total height of the perimeter piece 150 and core piece 152 of midsole 114 may be partitioned in accordance with the plantar pressure contour map in FIGS. 2 and 3. There may be between about 5 to 95 percent, sometimes between 10 to 90 percent and often 20 to 80 percent of the soft or firm foam material at any point within the midsole 114. The perimeter piece 150 may be very thin at the heel and the core piece 152 may be very thin at the arch, thus allowing for configurations to provide varying stiffness to reduce peak plantar pressures at the heel and arch regions. For example, in some embodiments, the firm foam may comprise a higher percentage of the midsole's total height at regions of higher plantar pressure. In one embodiment, the soft foam may comprise a higher percentage of the total height of the midsole at regions of lower plantar pressure. For example, the firm foam material may comprise between about 55 and 100 percent of the total midsole height at higher plantar pressure regions.

The foam material may include from 0 to 100 percent of hard or soft foam at any point of the midsole. In some embodiments, the soft foam may comprise a higher percentage of the midsole's total height at regions of higher plantar pressure. In one embodiment, the firm foam may comprise a higher percentage of the midsole's total height at regions of lower plantar pressure. In some embodiments, the soft foam material may comprise between about 55 to 100 percent of the total midsole height at higher plantar pressure regions. At lower plantar pressure regions, the hard foam material may comprise between about 55 to 100 percent of the total midsole height. At some regions, the soft and hard foams may be of equal heights.

As shown in FIG. 9, the variability of thickness relative to the perimeter and core materials, is illustrated and shows a continuous changing slope of the midsole to the forefoot in the longitudinal cross-section. An $\angle 1$ angle to horizontal for midfoot to forefoot may vary from 1° to 75° sometimes 2° to 55°, often 5° to 45°, with a preferred embodiment of a maximum of 15°. An angle, $\angle 2$ to horizontal from heel to midfoot may vary from 1° to 75° sometimes 2° to 55°, often 5° to 45°, with a preferred embodiment of a maximum of 30°. The angles may be selected to match the plantar aponeurosis. The plantar aponeurosis may gently arc from the calcaneus to the metatarsophalangeal joint by adjusting the angles and foam stiffness, and midsole deformation may be controlled.

The total height of the midsole 114 may be constant throughout or may vary at specific regions. The height of the midsole 114 may also be contoured based on the various plantar pressures of a foot. The total height of the midsole may comprise the perimeter piece 150 and the core piece 152 and their respective heights. It will be appreciated that the total height across the midsole may vary. This total midsole height variance may be made for a number of different reasons, including manufacturing, tradition, biomechanics, achilles tendon strain relief, and comfort particularly based on specific plantar pressure distributors. The total height at these regions may be between about 5 to 30 millimeters, often about 10 to 25 millimeters and in some instances, may be about 15 millimeters. Additionally, the ratio of firm versus soft materials may also be varied for other purposes than the reduction of peak plantar pressure. Examples may be optimization for walking, swinging a golf club or the like.

Figure 10:
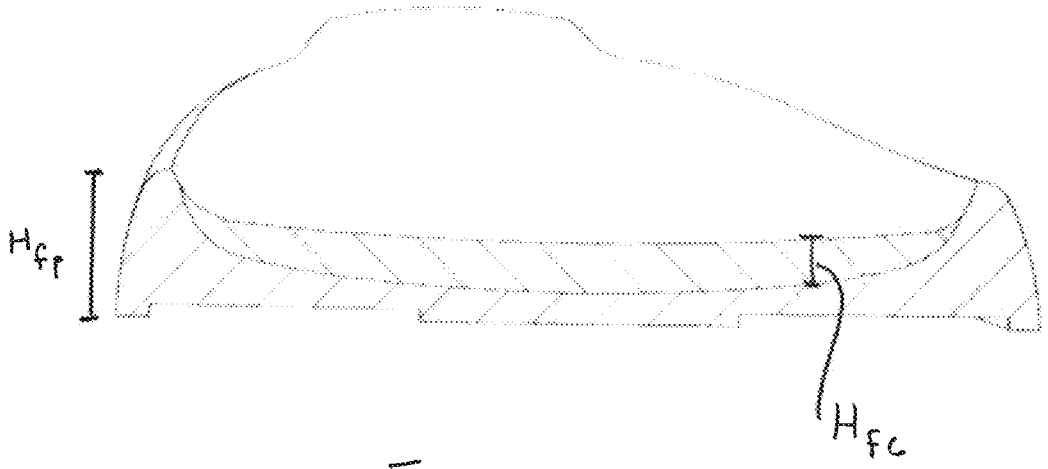
FIG. 10 is a cross-sectional view along line B-B of FIG. 8.
Figure 11:
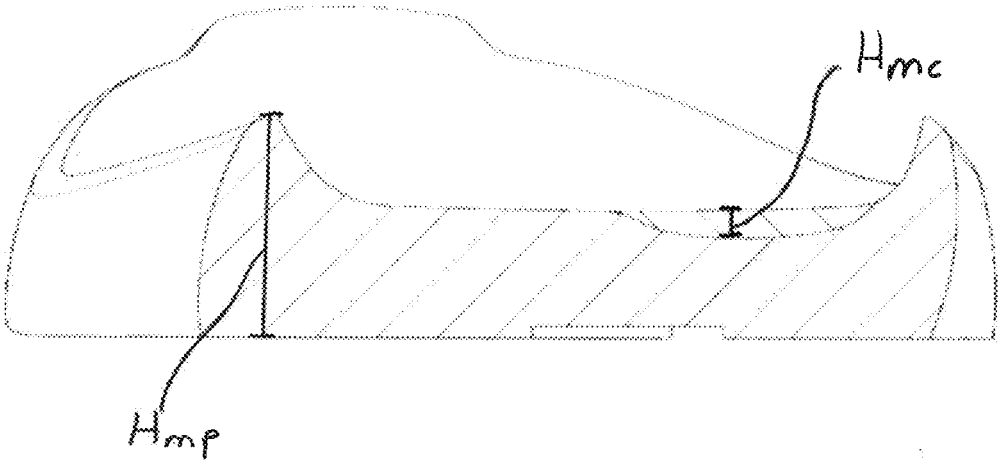
FIG. 11 is a cross-sectional view along line C-C of FIG. 8.
Figure 12:
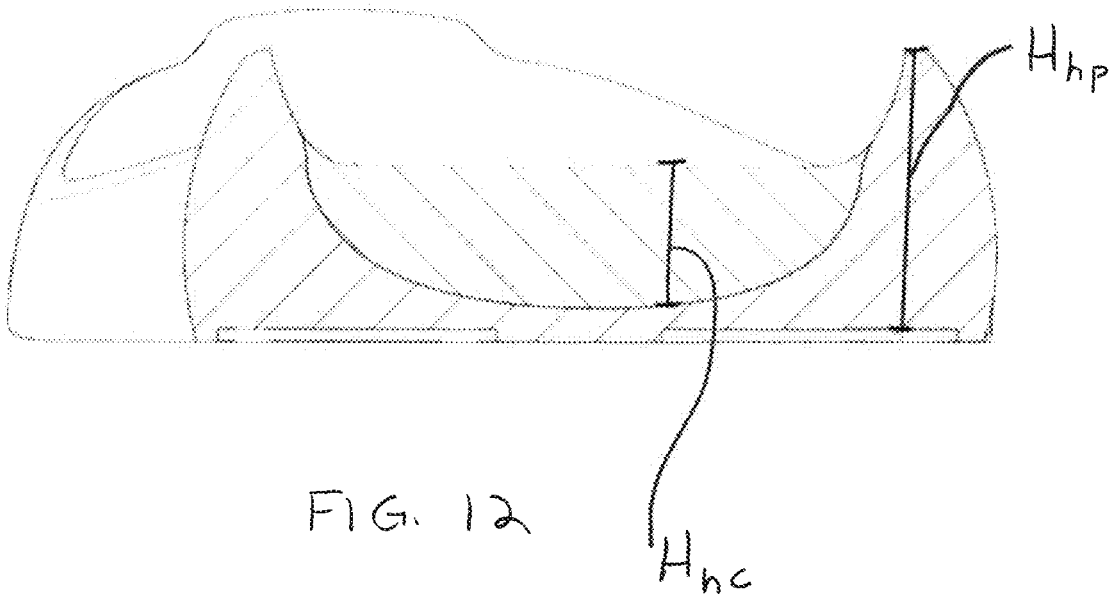
FIG. 12 is a cross-sectional view along line D-D of FIG. 8.

As seen in FIGS. 10-12, the total of the midsole comprising the height of the perimeter piece 150 and the core piece 152 may vary the height of each of the perimeter piece 150 and core piece 152 along the longitudinal length of the midsole from the forefoot region to the rear foot region and may also vary from the lateral side to the medial side of the midsole. The combination of the different heights of the core piece and perimeter piece at any given location varies the stiffness and is preferably based on a contour plot of peak plantar pressures.

Referring to FIG. 10, at the forefoot region 140, the perimeter piece may have a forefoot perimeter height $H_{fp}$ of 3 to 5 mm and the core piece may have a forefoot core height $H_{fc}$ of 3 to 5 mm.

Referring to FIG. 11, at the midfoot region 135, the perimeter piece may have a midfoot perimeter height $H_{fp}$ of 12 to 15 mm and the core piece may have a midfoot core height $H_{mc}$ of 0 to 3 mm.

Referring to FIG. 12, at the heel region 130, the perimeter piece may have a heel perimeter height $H_{hp}$ of 3 to 21 mm and the core piece may have a heel core height $H_{hc}$ of 3 to 21 mm.

In another embodiment, the core piece 152 may be contoured to match plantar pressure, wherein thicker regions of the core piece 152 may be positioned in regions of greater plantar pressure. For example, the core piece 152 may be vertically aligned with the metatarsophalangeal joints and the calcaneus of a foot as these are regions of greater foot depth and greater plantar pressures. The perimeter piece 150 may have an opening in the calcaneal region and metatarsophalangeal joint region for the core piece 152 to penetrate through to provide support in these high plantar pressure regions. Conversely, the perimeter piece 150 may be vertically aligned with the toes and vertical edge of a person's foot, wherein both are regions of lesser foot depths and plantar pressures.

Certain embodiments of the midsole 114 may include multiple foam pieces, i.e., more than two different foam pieces. The multiple foam pieces may each have a unique hardness, or in some instances, one or more of the pieces may share the same or substantially similar hardness. In some embodiments, one or more of the foam materials may further include substructures for additional support.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims.

That which is claimed is:

1. An article of footwear comprising:

an upper;

an outsole; and a two-piece midsole having a variable stiffness configured to reduce peak plantar pressures, wherein variable stiffness is provided by a firm foam material vertically aligned with a perimeter of the article of footwear and a soft foam material vertically aligned with a central heel region and a toe box region of the article of footwear and a combined height of the firm foam material and the soft foam material varies across the midsole, wherein the firm foam material is a first percentage of a total height of the midsole, and wherein the soft foam material is a second percentage of the total height of the midsole, wherein the first percentage and the second percentage vary across the midsole to provide the midsole with a midfoot region having a different hardness than a forefoot region or a heel region of the midsole, wherein the forefoot region and the heel region of the midsole are firmer than the midfoot region of the midsole.

2. The article of footwear of claim 1, wherein the midsole comprises a plurality of foam materials of differing stiffnesses.

3. The article of footwear of claim 2, wherein the midsole comprises a firmer foam material and a softer foam material, wherein the firmer foam material and the softer foam material vary an overall stiffness of the midsole dependent on a contour plot of peak plantar pressures.

4. The article of footwear of claim 3, wherein the softer foam material has an Asker® C hardness that varies between about 35 to 50, and wherein the firmer foam material has an Asker® C hardness that varies between about 55 to 70.

5. The article of footwear of claim 3, wherein the firmer foam material and the softer foam material differ in height (i) longitudinally along the midsole from a forefoot region to a rear foot region of the article of footwear or (ii) laterally along the midsole from a lateral side to a medial side of the article of footwear.

6. The article of footwear of claim 3, wherein the firmer foam material and the softer foam material are vertically aligned with each other and the total height of the midsole is a sum of a height of the firmer foam material and a height of the softer foam material.

7. The article of footwear of claim 6, wherein the total height of the midsole varies across a surface of the midsole.

8. The article of footwear of claim 6, wherein the heights of the firmer foam material and the softer foam material have a topology matching one or more the contours of a foot.

9. The article of footwear of claim 8, wherein the topology formed by the firmer foam material and the softer foam material comprises one or more nonlinear curves or one or more gradually linear curves.

10. The article of footwear of claim 7, wherein the softer foam material comprises between about 55 to 100 percent of the total height of the midsole at higher plantar pressure regions and the firmer foam material comprises between about 55 to 100 percent of the total height of the midsole at lower plantar pressure regions.

11. The article of footwear of claim 1, wherein the soft foam material is a higher percentage of a total height of the midsole than the firm foam material in the heel region and the forefoot region of the midsole, and wherein the firm foam material is a higher percentage of the total height of the midsole than the soft foam material in the midfoot region of the midsole.

12. The article of footwear of claim 1, wherein the firm foam material is a higher percentage of a total height of the midsole than the soft foam material in the heel region and the forefoot region of the midsole, and wherein the soft foam material is a higher percentage of the total height of the midsole than the firm foam material in the midfoot region of the midsole.

13. The article of footwear of claim 1, wherein the midsole has (i) a first surface area with a first high plantar pressure point and a first low plantar pressure point and (ii) a second surface area with a second high plantar pressure point and a second low plantar pressure point, wherein the first surface area is greater than the second surface area, and wherein the first surface area has a height gradient between the first high plantar pressure point and the first low plantar pressure point that is more gradual than a height gradient in the second surface area between the second high plantar pressure point and the second low plantar pressure point.

14. The article of footwear of claim 1, wherein the combined height of the firm foam material and the soft foam material varies across the midsole to provide the midsole with a continuously changing slope between the forefoot region and the heel region of the midsole, wherein a first portion of the slope extending between the midfoot region and the forefoot region has an angle of at most 15 degrees to horizontal, and wherein a second portion of the slope extending between the midfoot region and the heel region has an angle of at most 30 degrees to horizontal.

15. An article of footwear comprising:

an upper;

an outsole; and a midsole having a perimeter piece and a core piece, wherein a height of the perimeter piece and a height of the core piece throughout the midsole are configured to reduce peak plantar pressures, wherein the perimeter piece is thinner at a heel portion of the midsole than a midfoot portion of the midsole, and wherein the core piece is thinner in the midfoot portion of the midsole than in a forefoot portion of the midsole and the heel portion of the midsole.

16. The article of footwear of claim 15, wherein the perimeter piece has a forefoot perimeter height of about 3 to 5 mm, a midfoot perimeter height of about 12 to 15 mm and a heel perimeter height of about 3 to 21 mm and the core piece has a forefoot core height of about 3 to 5 mm, a midfoot core height of about 0 to 3 mm and a heel core height of about 3 to 21 mm.

17. The article of footwear of to claim 15, wherein the forefoot, midfoot and heel of the perimeter piece and the forefoot, midfoot and heel of the core piece comprise a plurality of thermoplastic foam materials of differing stiffnesses.

18. The article of footwear of claim 17, wherein the midsole comprises a firmer foam material and a softer foam material, wherein the firmer foam material and the softer foam material vary an overall stiffness of the midsole dependent on a contour plot of peak plantar pressures.

19. The article of footwear of claim 18, wherein the softer foam material has an Asker® C hardness that varies between about 35 to 50, and wherein the firmer foam material has an Asker® C hardness that varies between about 55 to 70.

20. The article of footwear of claim 15, wherein the perimeter piece includes a recess for receiving the core piece, wherein the recess does not extend into a medial midfoot region of the midsole.

* * * * *